US005220339A

United States Patent [19]

Matsushita

[11] Patent Number: 5,220,339

[45] Date of Patent: Jun. 15, 1993

[54] ANTENNA HAVING A CORE OF AN AMORPHOUS MATERIAL

[75] Inventor: Atsushi Matsushita, Fukui, Japan

[73] Assignee: Creatic Japan, Inc., Fukui, Japan

[21] Appl. No.: 421,142

[22] Filed: Oct. 13, 1989

[30] Foreign Application Priority Data

Nov. 2, 1988 [JP] Japan ..... 63-276147
Aug. 8, 1989 [JP] Japan ..... 1-203737

[51] Int. Cl.[5] ..... H01Q 7/08
[52] U.S. Cl. ..... 343/788; 343/787
[58] Field of Search ..... 343/788, 717, 787, 895

[56] References Cited

U.S. PATENT DOCUMENTS

| | | | |
|---|---|---|---|
| 1,523,798 | 1/1925 | Benson et al. | 343/788 |
| 2,204,286 | 6/1940 | Stevens | 343/878 |
| 2,932,027 | 4/1960 | Crowley | 343/788 |
| 3,364,487 | 1/1968 | Maheux | 343/713 |
| 3,549,818 | 12/1970 | Turner | 343/787 |
| 3,598,923 | 8/1971 | Turner | 343/788 |
| 4,101,899 | 7/1978 | Jones, Jr. et al. | 343/788 |
| 4,270,128 | 5/1981 | Drewett | 343/895 |
| 4,458,248 | 7/1984 | Lyasko | 343/788 |
| 4,510,489 | 4/1985 | Anderson, III et al. | 340/572 |
| 4,658,263 | 4/1987 | Urbanski | 343/788 |
| 4,823,113 | 4/1989 | Hasegawa | 340/551 |
| 4,849,692 | 7/1989 | Blood | 342/208 |
| 4,947,179 | 8/1990 | Ganter et al. | 343/718 |

FOREIGN PATENT DOCUMENTS

| | | | |
|---|---|---|---|
| 54-154245 | 12/1979 | Japan | 343/788 |

OTHER PUBLICATIONS

Mohri et al., "Magnetometers Using Two Amorphous Core Multivibrator Bridge", IEEE Transactions on Magnetics, vol. MAG-19, No. 5, Sep. 1983.

*Primary Examiner*—Rolf Hille
*Assistant Examiner*—Hoanganh Le
*Attorney, Agent, or Firm*—Bucknam and Archer

[57] ABSTRACT

An antenna element characterized that the core thereof is made of an amorphous metal and at least a part of its surface is wound with an electric conductive material, and an antenna comprising of at least one said antenna element.

4 Claims, 4 Drawing Sheets

ANTENNA HAVING A CORE OF AN AMORPHOUS MATERIAL

BACKGROUND OF THE INVENTION

1. Field of the Invention

This invention relates to the antenna, which has an element comprising a core made of amorphous metal and electric conductive material wound on the core.

2. Prior Art

Demands to smaller, lighters antennas with high performance than Yagi-antenna for VHF/UHF electromagnetic wave or parabola antenna for micro-wave have become substantial due to the technical development and spread of automobile TV, handy TV, satellite transaction, mobilization transaction, etc. as well as outlook of the facilities.

Several antennas such as di-pole antenna and combination of whip antenna and diversity circuit for automobile TV have been developed and available in the market. Those are, however, apt to be influenced by close noise from buildings and the receiving performance is not satisfactory. Furthermore, those are set at the outside of the automobile which disturbs car washing and/or parking in narrow space. Plane antenna (print antenna) is presently sold in the market as a smaller one than the parabola antenna for receiving satellite broad casting as well as mobilization transaction. This type of antenna also has a limitation to be made smaller due to receiving performance.

Additionally, conventional antennas have limited range of wave length to be utilized; for example, two deferent antennas are required to receive the VHF and UHF waves, both are required to have well adjusted length of the elements, that leads to complicated system as well as poor cost performance.

This invention provides a smaller and lighter antenna which can covers wider wave range, solving aforementioned problems of the prior art antennas.

SUMMARY OF THE INVENTION

The above mentioned object can be achieved with an antenna element comprising an amorphous metal core and electric conductive material wound on the core.

This invention is characterized by a core made of amorphous metal, at least part of which is surrounded by electric conductive material.

Amorphous metals, with higher magnetic permeability and less sensitive to the frequency, better magnetic properties such as high saturation magnetic flux density, less coercive force and less magnetostriction, are preferred as the core material of this invention. Maximun magnetic permeability of greater than approx. 10,000 $\mu$ max, or, more preferably greater than approx. 100,000 $\mu$ max are recommended. An amorphous metal with higher magnetic permeability and less sensitive to the frequency leads to better receiving performance of the antenna.

Amorphous metals generally have high strength, high hardness and high corrosion resistance which are also advantages as the material of the antenna.

Several types of amorphous can be utilized for this invention but iron-base and/or cobalt-base, especially Co—Fe—Si—B type and/or Fe—B—Si type are suitable to this invention. General characteristics of those amorphous metals as can e employed are set forth below.

Maximum magnetic permeability $\mu$max: 1,000–1,000,000

Saturation magnetic flux density Bs(KG): 5.5–18.0

Coercive force Hc (Oe) 0.003–0.4

Remained magnetic flux density Br (KG): 2.8–16.0

Initial magnetic permeability $\|i$ B=0.002T:2,000–15,000

Magnetostriction $\lambda s \times 10^{-5}$: 0–40

Curie point Tc (°C.): 205–415

The shape of the core can be chosen in accordance with the usage of the antenna, but is preferred to be bar or plate shape so that its body is capable of having electric conductive material wound on at least a part and to catch electromagnetic wave. Solid cylindrical or hollow pipe shape is most preferable among those. No strict specifications are required the structure of the core but a solid cylinder shape consisting of amorphous fiber and/or hollow pipe formed by winding a sheet shaped amorphous spirally is the most preferred. Dimension of less tham 500 micron-m, most preferably less than 25 micron-m in diameter for the fibers and in thickness for the sheet are recommended. Lower thickness or a smaller in diameter leads to less sensitivity of magnetic permeability to frequency.

In this invention, dimensions of above core are not limited and selected to achieve high receiving performance for example 150–600 mm in length and 2–8 mm in diameter is preferred for TV receiving antenna. It was found that the length of antenna within the range of $\frac{1}{8}$ to 10 times of wave length yields relatively good performance.

Electrical conductive material to be wound on the above core can be selected among conventional electrical conductive materials, especially copper and/or aluminum is preferred. The shape of such metal is not specially as long s it can be would around the core, but is preferred in the shapes of string, fiber or tape.

In this invention, the above electrical conductive material shall be wound on, at least a part of, above core. Method of winding is not specially specified, for example either clockwise or counter clockwise. Higher density of the wound coil and longer length of wound part of the core leads to better performance. Multilayer winding also yields better results. Printed sheet can also be used from such coil.

One unit element of this antenna can be used as an antenna, but two or more units can be combined to form an antenna, for example a combination of a unit based on hollow cylinder and that based on a solid cylinder consisting of fibers. In this case, cross angel between two units can be selected to achieve best performance, which is normally in the range of 30°–90°. If this is used as TV receiving antenna, 300–600 mm in length of former one and 150–300 mm in length of latter one is preferred.

The antenna element of this invention can be used in combination with conventional ones such as dipole antenna and whip antenna as well as with normal electric conductive wire antenna such as copper cable. Furthermore, it can be used with an apparatus such as diversity unit which is normally used with conventional antenna units. For example, two or more elements of antenna of this invention, or conventional antenna elements and an element of this invention are connected to the diversity unit which selects an element with best performance and connect to receiving unit.

This invention offers antennas for electromagnetic waves of audio frequency (AF) of 10 Hz–20 kHz, radio frequency (RF) of 20 kHz-300 GHz, micro wave of 1 Hz-300 GHz, UHF of 300 MHz-3GHz, VHF of 30 Hz-300 MHz, connecting either one of both ends of electric conductive material to the receiving unit. This invention especially offers an antenna which covers both UHF and VHF wave by one unit.

Several alternatives of shapes can be chose for particular application, for example a plate shape antenna with rubber magnet for automobile, with adapter for each setting and removal for automobile, in a shape of artificial flower for interior use, set on roofing material for exterior use, etc.

This invention offers also transmission antennas as well, which are not explained specially in this application document.

PREFERRED EMBODIMENTS

Actual performances of antennas of this invention are introduced thereunder in comparison with conventional antennas.

EXAMPLE 1

In this Example, amorphous fiber (made by Unitica, Co., Ltd., JAPAN under the tradename of Sency AC-20, 125 micron m in diameter) was used core material. Type and magnetic properties are as follows:

Type: Co—Fe—Si—B
Maximum magnetic permeability $\mu$max: approx. 100,000
Saturation magnetic flux density Bs(KG): 8
Coercive force Hc * (Oe): 0.06
(*added magnetic field was 2 Oe.)
Remaining magnetic flux density Br*(KG): 4
Magnetostriction $\lambda s \times 10^{-5}$: approx. 0
Curie temperature Tc (°C.): 368

Figure 1:
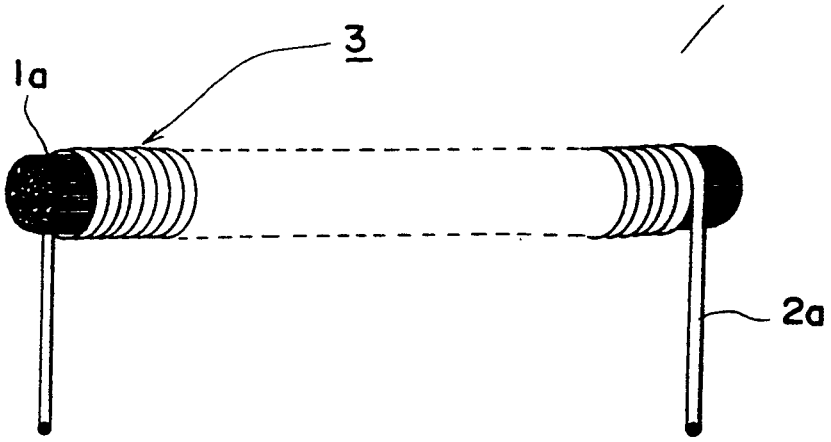
FIG. 1 is a side view showing a preferred embodiment of an antenna element of this invention.
Figure 2:
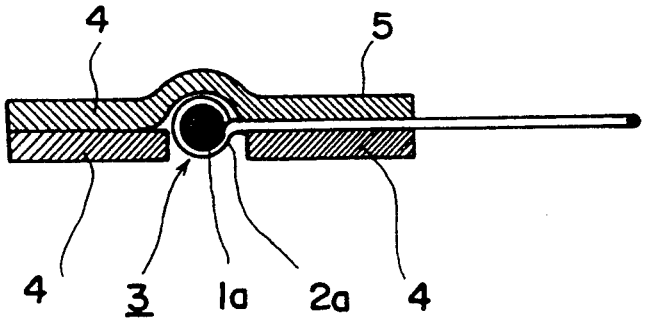
FIG. 2 is a cross section showing a preferred embodiment of a flat antenna of this invention.

Fifty (50) strings of amorphous fibers with 460 mm in length are bound in a solid cylindrical core (1*a*) and a alumina wire (2*a*) (1 mm in diameter and surface coated) are used to form antenna element (3) in FIG. 1. Aluminum wire (2*a*) was wound on the core (1*a*) from one end to the other as one layer, without generating gap between wire coils, and throughout the core length.

Then the above antenna element (3) was held between rubber mats (4) (460 mm in length, 25 mm in width, 2 mm in thickness) and fixed by polyvinyl chloride tape (5), to form a flat antenna to be set on the surface of automobile body plate.

Both ends of aluminum wire (2*a*) are connected to micro TV with liquid crystal display (manufactured by Matsushita Electric Industries, Co., Ltd., JAPAN, TY-RC49N), and the flat antenna was set on the roof of an automobile (manufactured by Nissan Automobile, Co., Ltd., JAPAN, Sunny Sedan) without considering direction of the antenna. Receiving performance was inspected as specified in Table 1 where the results are also listed.

Setting the flat antenna in the interior of the automobile body plate, gave almost same performance achieved.

EXAMPLE 2

Figure 3:
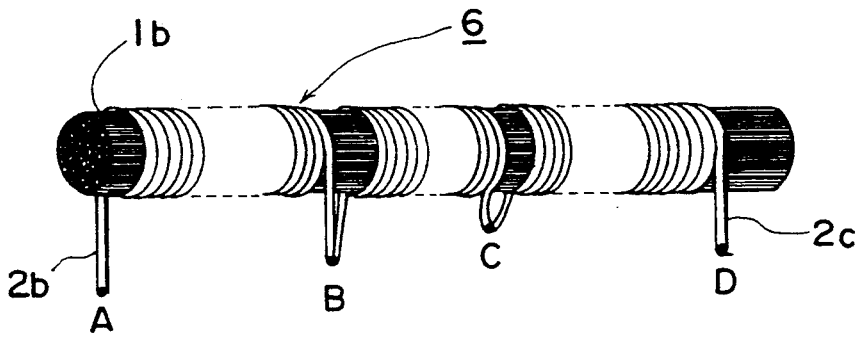
FIGS. 3 and 4 are side views showing other preferred embodiments of antenna elements of this invention.

An antenna element (6) as shown in FIG. 3 was made using solid cylindrical core (1*b*) consisting of 36 strings of amorphous metal fibers of 360 mm length in Example 1.

Copper wire (2*b*) (240 micron m in diameter, surface coated) was wound on the surface of core (1*b*) from one end to the direction of the other end as one layer with 60 mm width without having gap between coils, and of copper wire as A and B ends. The B end of copper wire is connected to aluminum wire (2*c*) (1 mm in diameter, surface coated) which was also wound on the surface of core (1*b*) in the width of 300 mm. The other end of aluminum wire was made to be D end. Furthermore, a terminal of C was made at the middle part of aluminum (2*c*) coil.

This antenna element (6) was formed to flat antenna (not shown) by the same way as Example 1 to be set no the automobile.

Two of terminal ends (A-B, A-C, A-D, B-C, B-D, C-D) were connected to a micro TV (manufactured by Matsushita Electric Industries, Co., Ltd., JAPAN, Transom SX TR-4030) and inspected for its performance by the same method as Example 1, and the results are introduced in Table 1.

Connecting only B end to a TV terminal for antenna, almost same results were obtained in comparison with the case of connecting two terminals including B end.

EXAMPLE 3

Amorphous metal sheet (manufactured by Allied Co., Ltd., USA, Metglas 2605S-2, 100 mm in width, 25 micron m in thickness) was used as core material. Type and magnetic properties are as below.

Type: Fe—B—Si
Maximum magnetic permeability $\mu$max: 500,000
Saturated magnetic flux desity Bs (KG): 15.6
Coercive force Hc* (Oe): 0.03
(*added magnetic field was 2 Oe.)
Remained magnetic flyx density Br* (KG): 13.0
Initial magnetic permeability [2 i B=0.002%: 5,000
Magnetostriction $\lambda s \times 10^{-5}$: 27
Curie temperature Tc (°C.): 415

Figure 4:
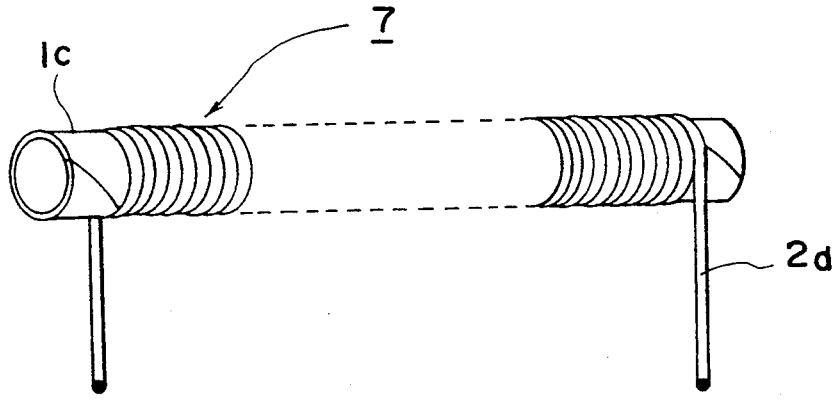

Hollow cylinder of 550 mm in length and 6 mm in diameter was made rolling above amorphous metal sheet spirally. An antenna element (7) as shown in FIG. 4 was manufactured which has same structure as in Example 1, except (1*a*) was replaced with core (1*c*). (2*d*) in FIG. 4 is aluminum wire.

Both ends of aluminum wire (2*d*) of the antenna element (7) were connected to micro TV as Example 1, but the antenna was set vertically on the roof of the same automobile. The results are shown in Table 1.

EXAMPLE 4

Figure 5:
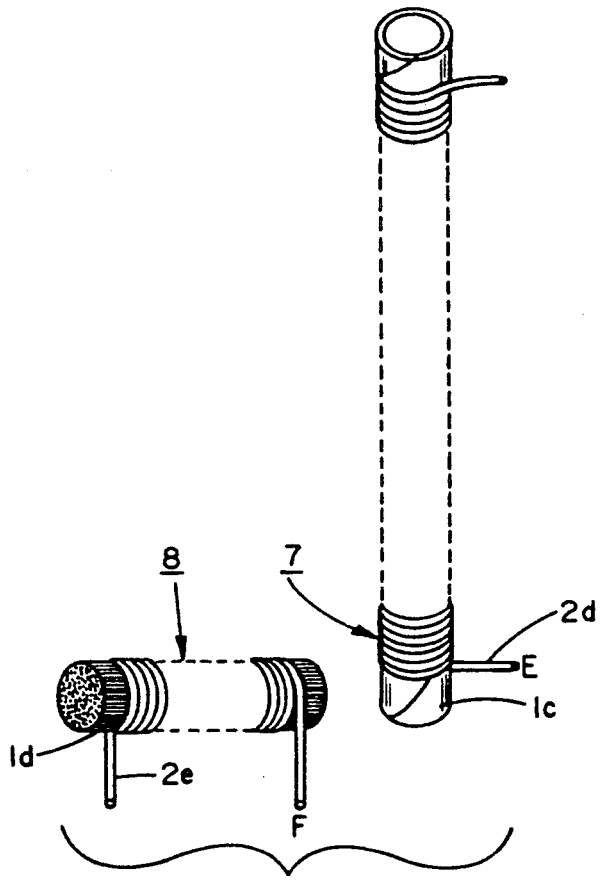
FIGS. 5 and 6 are side views to indicate arrangement of antenna elements in preferred embodiments of antennas of this invention.

Antenna element (8) in FIG. 5 were made in the same way as in Example 1, except using amorphous fibers having the length of 200 mm. The antenna element (7) in Example 3 was arranged together with above antenna (8) as in FIG. 5.

The distance between two antenna elements was 50 mm at the nearest ends, and both axes cross in the angle of 90°. Both are set with an adapter (not indicated) available in the market. In FIG. 5 (1*d*) the solid cylindrical core is from amorphous fibers, and (2*e*) is aluminum wire.

One end (E) of aluminum wire (2*d*) was connected to center code of coaxial cable, and the other end (f) of aluminum wire (2*e*) was connected to outer leading material and them finally connected to the TV as Example 1. This antenna was set on the automobile (Sunny Sedan) via adapter, where antenna element (7) was vertically fixed. Test results are introduced in Table 1.

EXAMPLE 5

Figure 6:
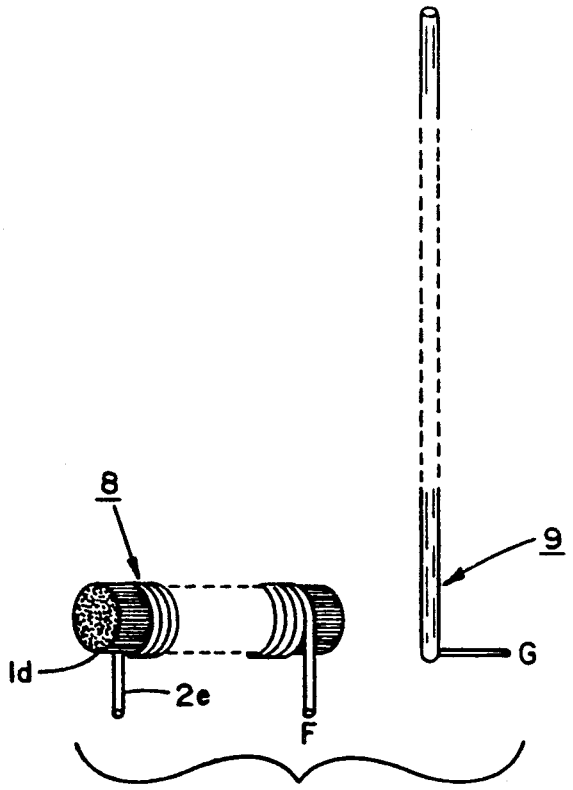
Figure 7:
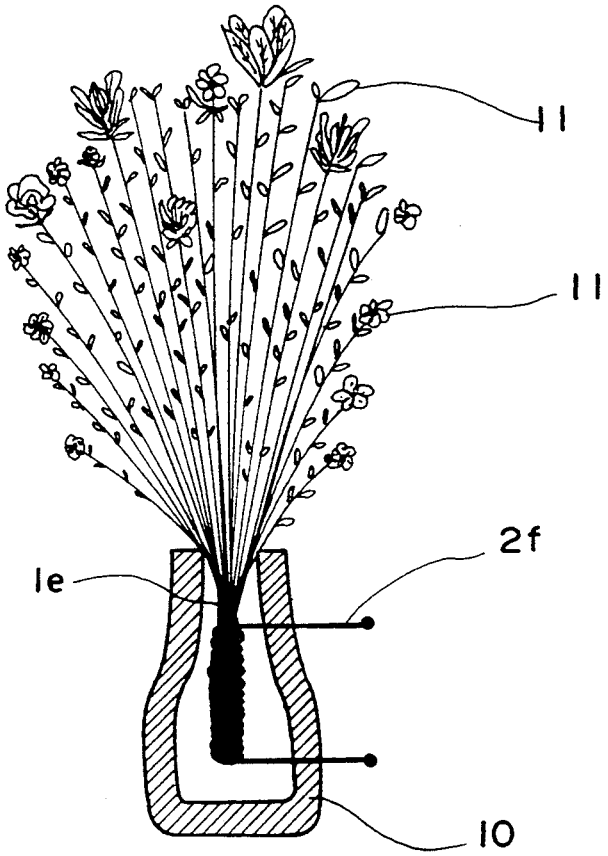
FIG. 7 is a partial cutaway cross section view showing a preferred embodiment of an interior antenna of this invention.

The same antenna as Example 4 except the antenna element (7) was replaced by copper wire (9) having the length of 500 mm and the diameter of 2 mm as shown in FIG. 6 was manufactured.

One end (F) of aluminum wire (2*e*) was connected to central conductive code of coaxial cable, and connecting terminal (G) of copper wire (9) was connected to outer conductive material of the coaxial cable. The coaxial cable was then connected to micro TV as Example 1, and the antenna was set on the roof of an automobile (Sunny Sedan) as Example 4. The test conditions and the results are shown in Table 1.

COMPARATIVE EXAMPLES 1-3

Comparative example 1 was carried out by using a conventional rod antenna supplied together with micro TV of Example 2, inside of the automobile.

In the comparative example 2 a conventional car TV antenna (manufacture by Matsushita Electric Industries, Co., Ltd., JAPAN, diversity antenna system for Toyota cars, TY-DU35CA-1) outside of the automobile as instructed by the manufacturer was used.

In comparative example 3 a film (plate) antenna (manufactured by Yagi antenna, Co., Ltd., JAPAN) set inside of rear window using both side sticking tapes was used.

Each antenna was connected to a micro TV as in Example 2 and was set on an automobile (Sunny Sedan) and inspected under the conditions of Table 1. The results are shown in Table 1.

TABLE 1

Receipt Results*1

| Cases | | I*2 | | | | II*3 | | | | III*4 | | | | IV*5 | | | |
|---|---|---|---|---|---|---|---|---|---|---|---|---|---|---|---|---|---|
| Channels*8 | | (3) | (9) | (11) | (39) | (3) | (9) | (11) | (39) | (3) | (9) | (11) | (39) | (3) | (9) | (11) | (39) |
| Example 1 | | F | F | F | F | F | F | F | V | V | F | F | V | V | F | V | V |
| Example 2 | A-B | E | E | E | E | — | — | — | — | — | — | — | — | — | — | — | — |
| *9 | A-C | E | E | E | F | — | — | — | — | — | — | — | — | — | — | — | — |
| | A-D | E | E | E | F | — | — | — | — | — | — | — | — | — | — | — | — |
| | B-C | E | E | E | E | F | F | F | F | F | F | F | F | | (all F-V) | | |
| | B-D | E | E | E | E | F | F | F | F | F | F | F | F | — | — | — | — |
| | C-D | E | E | E | E | — | — | — | — | F | F | F | F | — | — | — | — |
| Example 3 | | E | E | E | E | F | E | E | F | F | E | E | F | | (all F-V) | | |
| Example 4 | | E | E | E | E | E | E | E | F | E | E | E | F | F | F | F | V |
| Example 5 | | E | E | E | E | E | E | E | F | | (all F-V) | | | | (all F-V) | | |
| Comp. Ex. 1 | | V | F | F | V | N | N | N | N | N | N | N | N | N | N | N | N |
| Comp. Ex. 2 | | N | F | V | N | N | V | V | N | N | N | V | N | N | N | N | N |
| Comp. Ex. 3 | | N | F | F | V | V | V | V | V | V | V | N | V | N | N | N | N |

| Cases | | V*6 | | | | VI*7 | | | |
|---|---|---|---|---|---|---|---|---|---|
| Channels*8 | | (3) | (9) | (11) | (39) | (3) | (9) | (11) | (39) |
| Example 1 | | V | V | V | V | F | F | F | F |
| Example 2 | A-B | — | — | — | — | — | — | — | — |
| *9 | A-C | — | — | — | — | — | — | — | — |
| | A-D | — | — | — | — | — | — | — | — |
| | B-C | — | — | — | — | F | F | F | F |
| | B-D | | ( all F-V) | | | F | F | F | F |
| | C-D | — | — | — | — | — | — | — | — |
| Example 3 | | | (all F-V) | | | | (all F-V) | | |
| Example 4 | | | (all F-V) | | | | (all F-V) | | |
| Example 5 | | | (all F-V) | | | | (all F-V) | | |
| Comp.Ex. 1 | | N | N | N | N | N | N | N | N |
| Comp.Ex. 2 | | N | N | N | N | N | N | N | N |
| Comp.Ex. 3 | | N | N | V | N | N | V | N | N |

Notes:
*1 E: Excellent both image and voice
F: Voice is excellent with some disturbance in image
V: Voice is received without image
N: Both image and voice are not received
*2 In a parking car at approx. 4 km from broadcasting antenna without disturbing objectives.
*3 In a running car in the hilly area near to saddle, at approx. 10 km from broadcasting antenna.
*4 In a parking car in the hilly area near to saddle, at approx. 10 km from broadcasting antenna.
*5 In a running car at approx. 16 km from broadcasting antenna, a mountain exists between antenna and the car.
*6 In a running car in hilly area at approx. 23 km from broadcasting antenna.
*7 In a parking car in hilly area at approx. 23 km from broadcasting antenna.

| *8 Channels | Image | Voice |
|---|---|---|
| 3: NHK Educational (VHF); | 103,25 MHz, | 107.75 MHz |
| 9: NHK General (VHF): | 199.24 MHz, | 203.74 MHz |
| 11; FBC Fukui Broadcasting; | 211.24 MHz, | 215.74 MHz |
| 39; FTB Fukui TV; | 627.24 MHz, | 631.74 MHz |

*9 Combination of connected terminals (A-B, A-C, A-D, B-C, B-D, C-D)

As proved by Examples 1 to 5 and Comparative Examples 1 to 3, this invention enables to receive VHF and UHF TV broadcasting excellently, better than conventional antenna regardless of direction of automobile.

Combination of two antenna elements of this invention as Example 4, as well as that of one of this invention and conventional one as Example 5, also provide high performance antennas.

EXAMPLE 6

Thirty (30) strings of amorphous metal fibers of within 500–750 mm in length are ties up in a bundle as to have one end flat. Aluminum wire (*2f*) (1 mm in diameter, surface coated) was wound on the bundle core (1*e*) to 300 mm from the flat end, in one layer to not form gaps between the coils. The core part (1*e*) was inserted into a conventional vase made of porcelain of approx. 400 mm in height and approx. 150 mm in maximum diameter. Part of amorphous fibers not bound and outside of base was decorated with artificial flowers and leaves to make interior antenna.

Both ends of aluminum wire (*2f*) were connected to micro TV set utilized in Example 1 and TV broadcasting were received in a timber made two stores house located within a distance of 4 km from broadcasting antenna without disturbing objective around the house, as introduced in Table 2. Direction and location of the antenna was not specially arranged. The results are shown in the same Table.

EXAMPLE 7

Figure 8:
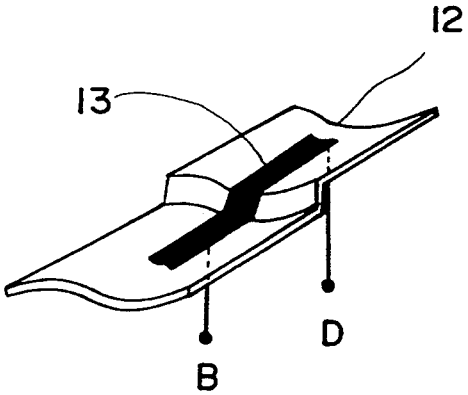
FIG. 8 is an perspective view showing a preferred embodiment of a roof antenna of this invention.

Roof antenna as shown in FIG. 8 was formed using the flat antenna as utilized in Example 2.

The above mentioned flat antenna element (13) was fixed on a colored steel sheet (12) (1 mm in thickness, 300 mm in width, 700 mm in length) which was formed to be set on the roof tiles (bend in width direction and 20 mm height step at the middle in length).

The antenna thus made was fixed on the roof tile of the house utilized in Example 6, regardless to the direction of broadcasting antenna, and terminals B and D of antenna element (13) were connected to micro TV set utilized in Example 6. The TV set was set inside of the house. The results are shown in Table 2.

COMPARATIVE EXAMPLES 4 AND 5

A Yagi antenna for VHF were receipt (manufactured by Masspro Antenna Co., Ltd., JAPAN, with two guide bars and two reflection bars) and a Yagi antenna for UHF wave receipt (manufactured by Matsushita Electric Industries, Co., Ltd., JAPAN, with six guide bars and one reflection bar), both purchased in the market were used for Comparative Examples 4 and 5, respectively. In both cases, the antennas were set over the roof of the house employed in Example 6.

Conditions of the TV set were the same as Example 7. The results are shown in Table 2 as well.

TABLE 2

| | Receipt Results*1 | | | |
|---|---|---|---|---|
| | (3) | (9) | (11) | (39) |
| Example 6 | E | E | E | E |
| Example 7 | E | E | E | E |
| Comp. Ex 4 | E | E | E | P |
| Comp. Ex 5 | P | P | P | E |

Notes:
*1 Channels 3, 9, 11, 39 are the same as specified in Table 1.
E: Excellent without any turbulence
P: Flickers in image Examples 6–8 and Comparisons 4–5 proved that this invention offers an antenna which receives both UHF and VHF waves by a single unit, regardless whether in the interior or exterior of a house.

EFFECTS OF THE INVENTION

As explained above, this invention offers an antenna, small in size, light in weight, and with high sensitivity as well as for wide rage frequency wave. The antenna invented herewith can be shaped in several ways to set in several places easily, and can be decorated with several material. Therefore this type of antenna can be used as for car TV, handy TV, home-use TV, satellite transmission, mobile transmission, or others, especially for automobile TV and home use TV.

What is claimed is:

1. An antenna element for receiving signals of VHF and UHF comprising a core made of an amorphous metal, said core having a surface, at least a part of said surface has an electric conductive material wound thereon, said electric conductive material having been coated with an insulating material prior to winding; wherein said core has the shape of a hollow cylinder and said core is formed by rolling spirally a sheet shaped amorphous metal.

2. An antenna element for receiving signals of VHF and UHF comprising a core made of an amorphous metal, said core having a surface, at least a part of said surface has an electric conductive material wound thereon, said electric conductive material having been coated with an insulating material prior to winding; wherein said core has the shape of a solid cylinder and comprises amorphous metal fibers.

3. An antenna for receiving signals of VHF and UHF which comprises at least one antenna element comprising a core made of an amorphous metal, said core having a surface, an electric conductive material wound around at least part of said surface, said electric conductive material having been coated with an insulating material prior to winding, said core has the shape of a hollow cylinder and said core is formed by rolling spirally a sheet shaped amorphous metal.

4. An antenna for receiving signals of VHF and UHF which comprises at least one antenna element comprising a core made of an amorphous metal, said core having a surface, an electric conductive material wound around at least part of said surface, said electric conductive material having been coated with an insulating material prior to winding, wherein said core has the shape of a solid cylinder and wherein said core comprises amorphous metal fibers.

* * * * *